US011050146B2

(12) United States Patent
Kirknes

(10) Patent No.: US 11,050,146 B2
(45) Date of Patent: Jun. 29, 2021

(54) WIDEBAND ANTENNA BALUN

(71) Applicant: Norbit ITS, Trondheim (NO)

(72) Inventor: Steffen Kirknes, Ranheim (NO)

(73) Assignee: Norbit ITS, Trondheim (NO)

( * ) Notice: Subject to any disclaimer, the term of this patent is extended or adjusted under 35 U.S.C. 154(b) by 0 days.

(21) Appl. No.: 16/480,222

(22) PCT Filed: Jan. 24, 2018

(86) PCT No.: PCT/EP2018/051649
§ 371 (c)(1),
(2) Date: Jul. 23, 2019

(87) PCT Pub. No.: WO2018/138111
PCT Pub. Date: Aug. 2, 2018

(65) Prior Publication Data

US 2019/0372212 A1 Dec. 5, 2019

(30) Foreign Application Priority Data

Jan. 25, 2017 (NO) ..... 20170110

(51) Int. Cl.
*H01Q 1/50* (2006.01)
*H01Q 9/28* (2006.01)

(52) U.S. Cl.
CPC ..... *H01Q 1/50* (2013.01); *H01Q 9/285* (2013.01)

(58) Field of Classification Search
CPC ..... H01Q 1/50; H01Q 9/285; H01Q 1/38; H01Q 9/06; H01P 5/10
(Continued)

(56) References Cited

U.S. PATENT DOCUMENTS 2,530,048 A 11/1950 Driscoll
4,495,505 A 1/1985 Shields
(Continued)

FOREIGN PATENT DOCUMENTS

DE 963794 C 5/1957
DE 19912465 A1 10/2000
(Continued)

OTHER PUBLICATIONS

Topak, Eray, "International Search Report" for PCT/EP2018/051649, dated May 4, 2018, 5 pages.

*Primary Examiner* — Don P Le
(74) *Attorney, Agent, or Firm* — Shackelford, Bowen, McKinley & Norton, LLP

(57) ABSTRACT

Present invention is an antenna comprising, a first element and a second element, said first element and second elements arranged to be poles of the antenna, and the antenna being adapted to be fed by a feeding network, wherein the feeding network comprises, a first feed line having a first electrical conductor and a second electrical conductor and a second feed line having a third electrical conductor, wherein the first electrical conductor is adapted to be electrically connected to the first antenna element at or close to the first antenna end, the second electrical conductor is adapted to be electrically connected to the second antenna element at or close to the first antenna end, the third electrical conductor is adapted to be electrically connected to the second antenna element at or close to the second antenna end, wherein the feeding network also comprises an electrical connection between the first electrical conductor and the third electrical conductor, the electrical connection being at a connection point located at a predetermined distance from a reference point related to the antenna elements, and said predetermined distance being shorter than at least one of the first
(Continued)

Figure 1:
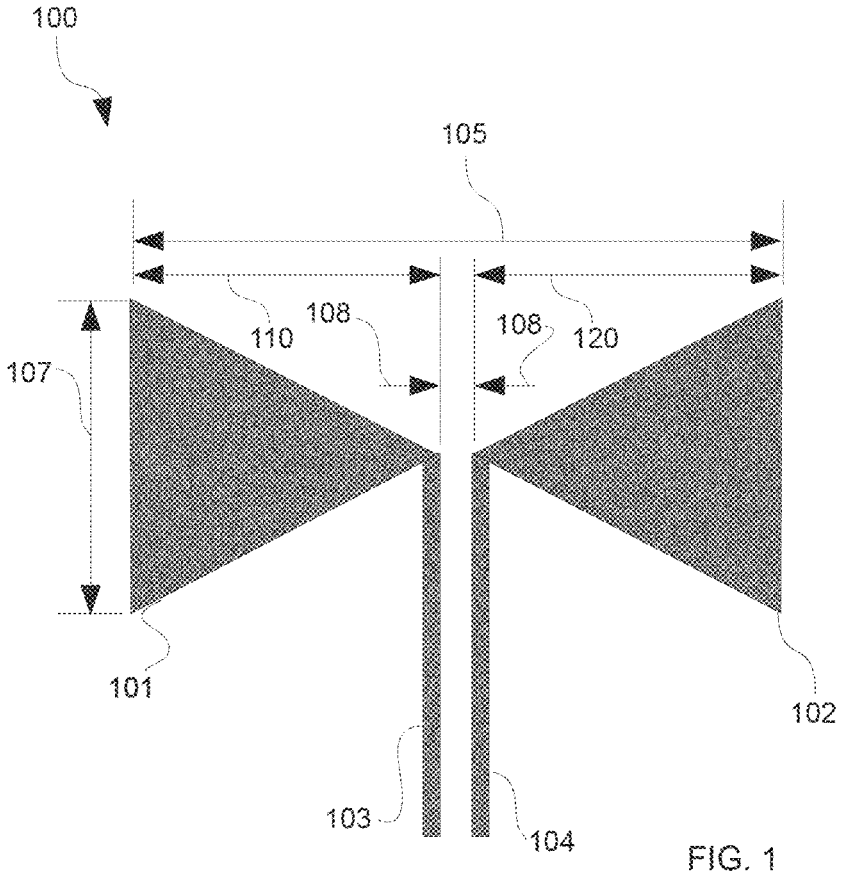

length and the second length. Present invention is also an antenna balun comprising a first feed line and a second feed line.

18 Claims, 3 Drawing Sheets

(58) Field of Classification Search
USPC ..... 343/793
See application file for complete search history.

(56) References Cited

U.S. PATENT DOCUMENTS 4,758,843 A * 7/1988 Agrawal ..... F16K 17/24 343/700 MS
5,068,672 A 11/1991 Onnigian et al.
5,977,842 A 11/1999 Brown et al.
6,323,820 B1 * 11/2001 Haunberger ..... H01Q 9/16 343/793
6,906,675 B2 6/2005 Satoh et al.
7,098,863 B2 8/2006 Bancroft
2001/0011964 A1 * 8/2001 Sadler ..... H01Q 9/16 343/824
2008/0158081 A1 * 7/2008 Rofougaran ..... H01L 25/0655 343/787
2008/0238800 A1 10/2008 Collins
2008/0309572 A1 * 12/2008 Parsche ..... H01Q 9/285 343/795
2009/0289866 A1 * 11/2009 Parsche ..... H01Q 9/28 343/790
2011/0248900 A1 10/2011 de Rochemont
2015/0109167 A1 * 4/2015 Yarga ..... H01Q 1/243 343/700 MS
2015/0138032 A1 5/2015 Yona et al.
2016/0034807 A1 * 2/2016 Forster ..... B32B 41/00 235/492
2019/0372212 A1 * 12/2019 Kirknes ..... H01Q 1/50
2020/0184173 A1 * 6/2020 Jiang ..... G06K 19/077

FOREIGN PATENT DOCUMENTS

GB 772605 A 4/1957
JP 2002374118 A 12/2002
JP 2004289371 A 10/2004
JP 2006014157 A 1/2006
KR 20160091847 A 8/2016

* cited by examiner

WIDEBAND ANTENNA BALUN

The present teachings generally relate to antennas. More specifically, the present teachings relate to antennas for receiving and transmitting an electromagnetic signal.

Bandwidth of dipole antenna elements can be increased by arranging them in a biconical or a bow-tie type shape, or their likes. A dipole antenna should preferably be fed using a balanced transmission line, however feeding lines such as coaxial type are unbalanced transmission lines wherein, one terminal is typically at a ground potential. Such unbalanced transmission lines can also be called single-ended transmission lines, or simply single-ended lines. Since a dipole antenna presents a balanced input, i.e., both terminals typically having an equal but opposite voltage with respect to ground, when a balanced antenna is fed with an unbalanced or a single-ended line, common mode currents can cause the coax line to radiate in addition to the antenna itself. Unwanted effects arising when a dipole antenna is fed with an unbalanced line may include, distortion in the radiation pattern, and alteration in the impedance seen by the line.

One way to properly feed the dipole whilst retaining its expected characteristics is by using a balun in between the coaxial feedline and the antenna terminals.

Transformer type baluns are commonly used with HF-antennas, but become lossy and bulky at higher frequencies as VHF and UHF, where delay line type baluns are more common. Delay line baluns may however suffer from limited bandwidth, as the phase-shift of a delay line is frequency dependent. In addition Pawsey stub type balun configurations are also known that require a quarter wavelength stub to balance the antenna feed.

The above-mentioned and other problems inherent to the prior art will be shown solved by the features of the accompanying independent claims.

According to an object of the present teachings it can be provided a balun that reduces radiation from an unbalanced feeder of a wideband dipole, whilst extending the low frequency range. Said unbalanced feeder is for example a coaxial cable. Accordingly, the frequency range of the wideband dipole can be enhanced, or the dipole can be made more wideband.

According to another aspect a use of a connection point between the conductors of the feeding network to increase the wideband performance of an antenna can be provided.

In a further object of the present teachings it can be provided an antenna or antenna arrangement to simultaneously provide a second feed for an auxiliary antenna.

A typical application of the present teachings can be a combined multi-band mobile and GPS antenna, however the person skilled in the art will understand that the present teachings can be applied in other wireless and transmission-line applications as well. All embodiments and aspects of the present teachings in this disclose are meant to be examples demonstrating the present invention in a simple form for ease of understanding. The examples are not meant as limitations, or as affecting the scope of the present teachings. The skilled person will further appreciate that the teachings can also be applied to other kinds of symmetrical or balanced antennas, and is not limited to dipole antennas only. For keeping the discussions concise and simple the case the term dipole antenna is used in the rest of the disclosure without limitation and without affected the scope.

The invention will now be discussed more in detail using the following drawings illustrating certain aspects of present teachings by way of examples. The figures are not necessarily drawn to scale.

Figure 2:
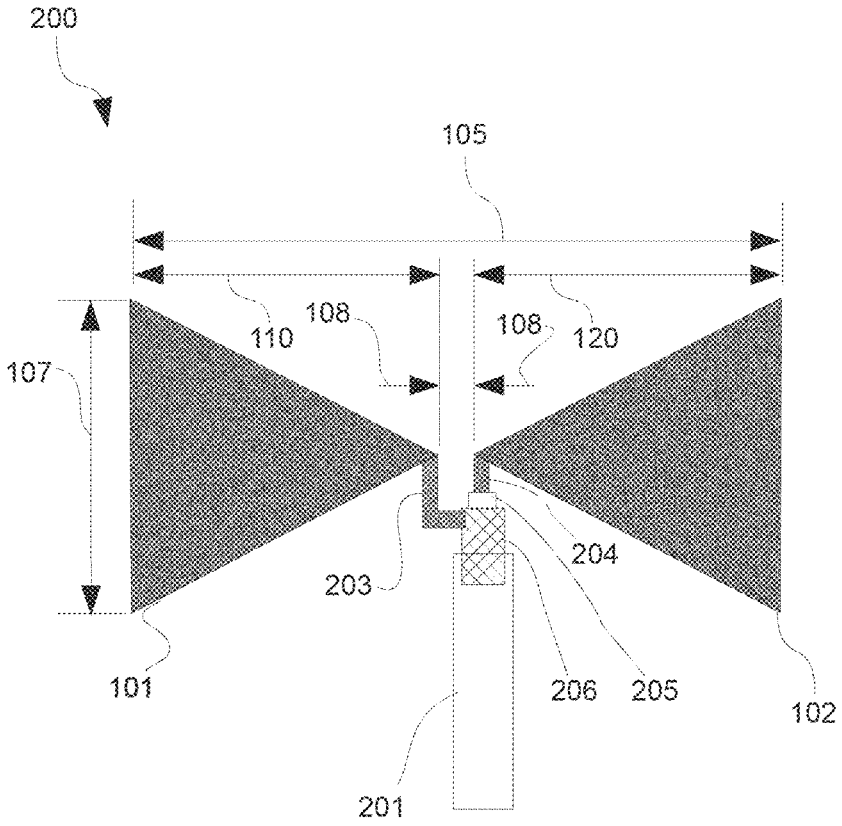
Figure 3:
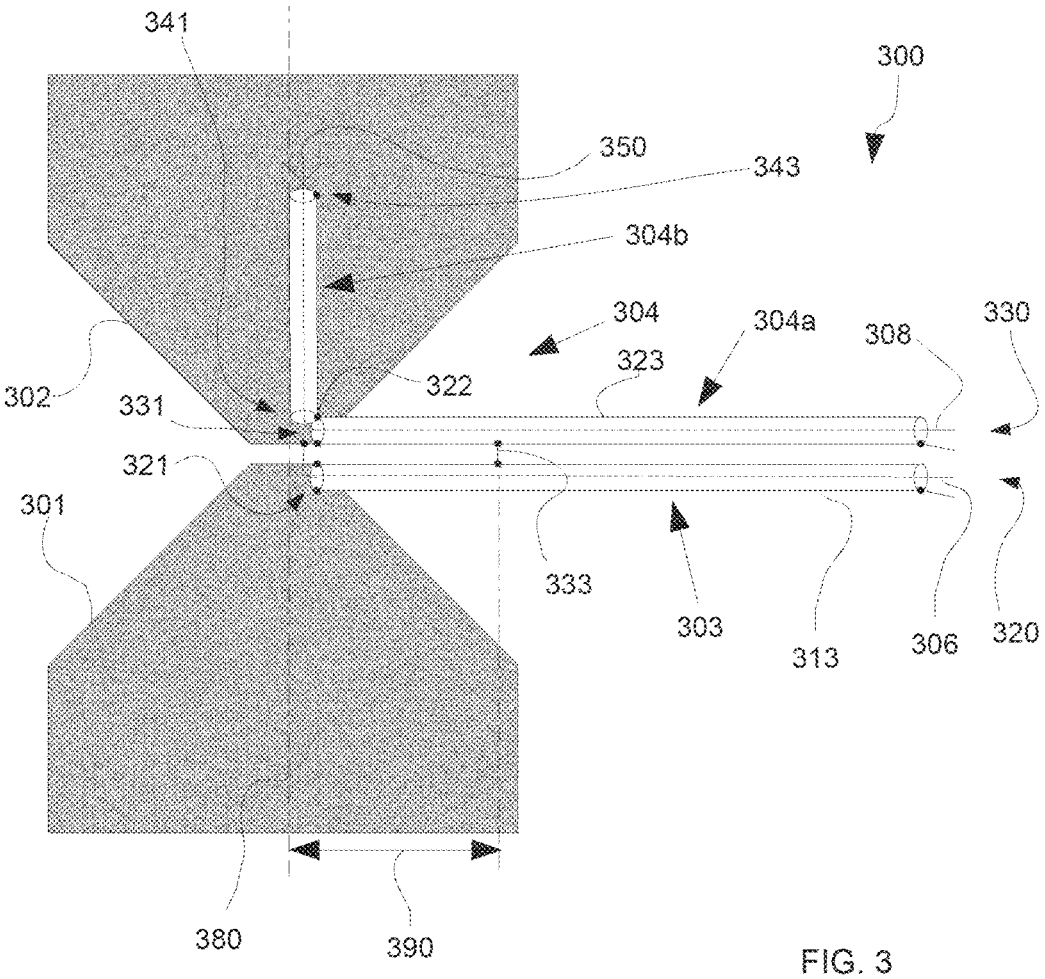

FIG. 1 illustrates a simple bow-tie type dipole antenna connected to a balanced feeder FIG. 2 illustrates a simple bow-tie type dipole antenna connected to a coaxial feeder FIG. 3 illustrates an embodiment of the present teachings when applied to a bow-tie dipole antenna FIG. 1 shows a simple bow-tie type dipole antenna 100. The antenna 100 comprises two identical elements 101 and 102. The first antenna element 101, on the left hand side, in the figure is electrically connected to a first feeding line 103. The second antenna element 102, on the right hand side, in the figure is electrically connected to a second feeding line 104. Each of the antenna elements 101 and 102 have identical width 107. Furthermore, the length 110 of the first antenna element 101 is identical to the length 120 of the second antenna element. In terms of physical dimensions, the dipole antenna 100 has a total length 105 which is usually half the wavelength of frequency of interest. Due to the width 107 the antenna appears longer and also provides more bandwidth.

The antenna elements 101 and 102, also called poles of the dipole 100, are spaced apart by a relatively small spacing width 108. This spacing width is typically substantially small such that the sum of the lengths 110 and 120 of the antenna elements 101 and 102 is approximately equal to the length 105 of the antenna 100. In FIG. 1, the feeder line consisting of the first feeding line 103 and the second feeding line 104 is shown symmetrical and balanced.

FIG. 2 shows a case where a dipole antenna 200 is connected to an unbalanced feeder. In this case, the unbalanced feeder is shown in the form of a coaxial cable 201. The shown coaxial cable 201 comprises two conducting paths; first is a braided shield or mesh 206 that is connected to the first antenna element 101 through a first conductor 203. The first conductor 203, for example can be a solder patch or such. The second is an inner conductor 204 of the coaxial cable 201. The inner conductor 204 is connected to the second antenna element 102. This conductor 204 can also be soldered, or be connected by any other suitable means to the second antenna element 102. The inner conductor 204 is electrically insulated from the braided shield by a dielectric or insulator 205. The braided mesh 206 is further shown isolated by black isolation except for the portion of the cable 201 that is shown exposed in the figure, i.e., the portion where the braided mesh 206 is visible. A person skilled in the art will note that coaxial cable is shown as an example only, in practice an unbalanced feed even as a coaxial conductor may also be applied as a PCB trace or similar. In other words, the feed need not be using an actual cable per se.

An unbalanced feed may also be implied by non-symmetrical signals applied to a symmetrical antenna.

As discussed previously, such an unbalanced arrangement as shown in FIG. 2 is not desirable due to problems mentioned previously in this disclosure.

Now referring to FIG. 3, which shows an antenna arrangement 300 that shows embodiments according to an aspect of the present teachings when applied to more of an hourglass shaped dipole antenna. In this example, an hourglass shape is demonstrated for example to achieve a more wideband response. The antenna shape is not to be considered limiting to the scope or generality of the present teachings; it is rather selected dependent upon what kind of characteristics are desired. The dipole antenna shown in FIG. 3 comprises two electrically conducting elements or poles 301 and 302 respectively. The poles are aligned symmetrically along an axis 380 that runs along the 105 length of the antenna 300.

The antenna arrangement 300 also comprises a first feed line 303. The first feed line 303 comprises two conducting lines 313 and 306. The first feed line 303 has a first length spanning between a first device end 320 and a first antenna end 321. The first conducting line or first electrical conductor 313 is shown as an outer conductor of a coaxial type arrangement. For the case of a coaxial cable, the first conducting line 313 would correspond to the braided shield, for example as 206 shown in FIG. 2. For other types of coaxial arrangements, such as delay line type PCB traces, the first conducting line 313 will correspond to the outer conductor. The second conducting line or second electrical conductor 306 is shown as an inner conductor of a coaxial type arrangement. The first electrical conductor 313 and the second electrical conductor 306 are electrically isolated from each other along the first length. For a coaxial cable, the first conductor 313 and the second conductor 306 are typically isolated by a dielectric. For the case of a coaxial cable, the second conducting line 306 would correspond to the inner conductor, for example as 204 shown in FIG. 2. For other types of coaxial arrangements, such as delay line type PCB traces, the second conducting line 306 will correspond to the inner conductor. The first device end 320 is arranged to be connected to a device (not shown in the figure) using the antenna arrangement 300 (the device is not shown in the figure). At the antenna end 321 the first conducting line 313 is electrically connected to the first antenna element 301. The second conducting line 306 is electrically connected to the second antenna element 302. A person skilled in the art will appreciate that an arrangement consisting of the first antenna element 301, the second antenna element 302, and the first feed line 303 arranged as explained above corresponds to the antenna arrangement of FIG. 2.

The antenna arrangement 300 further comprises a second feed line 304. The second feed line 304 comprises two conducting lines 323 and 308, namely third conducting line or third electrical conductor 323 and fourth conducting line or fourth electrical conductor 308 respectively. The second feed line 304 is shown spilt in two parts 304*a* and 304*b* respectively in the figure. The first part 304*a* has a second length spanning between a second device end 330 and a second antenna end 331. The second part 304*b* has a third length spanning between a third antenna end 341 and a remote end 343. The functionality associated with the second part 304*b* of the second feed line 304 is to be covered under another aspect of the present teachings, and should be considered as a preferable embodiment of the teachings rather than being essential to the most general embodiment of the present teachings. Furthermore, a corner or knee between ends 321 and 331 is shown primarily to highlight that the third conducting line 323 is connected to the second antenna element 302 at or close to the second antenna end 321. The fourth conducting line 308 is not conductively connected to either of the antenna elements 301 or 302, instead the fourth conducting line 308 is connected to or forms an auxiliary antenna 350. The third conducting line 323 is also further conductively connected to the second antenna element 302 at or close to the remote end 343. In case of a coaxial arrangement the first conducting line 313 and the third conducting 323 line can also be called screening conductors. A conductive connection 333, preferably in the form of a short circuit, is made between the first conducting line 313 and the second conducting line 323 at a predetermined length 390 from the antenna elements. The predetermined length 390 is less than the first length and the second length. According to another embodiment, the predetermined length is less than the width 107 of the elements.

According to one aspect of the present teachings, by electrically connecting the first conducting line 313 and the third conducting 323 line, at the connection point 333 located at a predetermined distance 390 from the antenna elements, the connection point 333 becomes an artificial neutral ground level, as the opposite polarized voltages at the feeds of the dipole add to a zero at this point. The predetermined distance can be defined with respect to a reference point related to the antenna elements. The predetermined distance or predetermined length 390 is in this case has been defined as the distance between the axis 380 and the location of the electrical connection 333.

A skilled person will appreciate that usually for a given lowest frequency of interest, the antenna length, for example 105, should be essentially half wavelength corresponding to the lowest frequency of interest. In conventional antennas, for frequencies below the lowest frequency of interest, the antenna impedance becomes capacitive such impedance mismatch will occur and the antenna will become ineffective. The applicant has realized that this can be compensated by choosing the distance 390 of the connection point 333 such that reactive current flowing through the connection point 333 via conductors 313 and 323 becomes essentially inductive and thus essentially compensates the capacitive nature of the antenna such that the antenna may be used at frequencies lower than given by the physical length of the antenna according to the half wavelength principle explained above. It can be appreciated the location of the connection point 333, or the distance 390 of it, will alter the effective inductive impedance offered by the connection point 333. The distance 390 of the connection point 333 can thus be chosen such that desired compensation is achieved.

From the above, it can thus be appreciated that such an antenna, according to the present teachings, can save physical space and costs. In simpler terms, now in context of FIG. 3, it can be said that the distance 390 to the connection point 333 can be selected such that the impedance presented by the antenna arrangement is predominantly resistive even at frequencies below half wavelength physical length where the dipole itself becomes predominantly capacitive. According to the present teachings, the impedance presented by the antenna arrangement with the connection point is made predominantly resistive by compensating the capacitive behavior of the dipole at low frequencies by the essentially inductive behavior introduced by the connection point 333.

According to one aspect, the distance 390 of connection point 333 is at or below $\lambda/4$, where $\lambda/2$ is the half wavelength of the antenna elements defined by the physical dimensions of the antenna. Accordingly, due to the connection point 333, the antenna is able to operate at frequencies substantially lower than the $\lambda/2$ defined due to physical dimensions of the antenna. According to another aspect, the distance 390 is at or below $\lambda/6$. According to yet another aspect, the distance 390 is at or below $\lambda/8$.

As an example, with a bow-tie antenna having a length of around 10 cm, a distance 390 of around 5 cm the applicant has been able to operate the same antenna for lowest frequencies close to 700 MHz, which otherwise would have required an antenna length of around 21.5 cm. An appreciable space and cost benefit is thus achieved. A skilled person will realize that limits to lower frequencies will depend on the antenna design, and that presented example does not specify a limit of operation.

The present teachings can therefore improve the impedance of the dipole antenna arrangement at low frequency without degenerating the impedance at the upper frequency range.

Person skilled in the art will notice that the second feed line 304 adapted to carry the signal for an auxiliary antenna 350 is optional. Instead of the auxiliary antenna 350, the fourth conducting line may also be connected to a sensor located on one of the poles, 301 or 302, of the main antenna. The second feed line can thus offer additional space and cost advantages according to another aspect of the present teachings.

According to another embodiment, the second part 304*b* of the second feed line 304 lies at least partially over or partially overlaps the the second element 302.

As another example, the antenna has the length 105 is around 100 mm, the width 107 is around 60 mm, and the predetermined distance 390 is around 22 mm. According to this embodiment, the antenna is operable typically from around 800 MHz and two octaves up. A person skilled in the art will understand that these dimensions are provided just as an example, the scope of this embodiment also covers the proportions between the mentioned dimensions, as well as dimensioning of various elements to achieve a given response or performance.

By adapting the antenna design, other frequency ranges can be achieved. For example, by appropriately shaping the antenna elements to increase the area, and by reducing the opening angle to adapt more of a Vivaldi antenna shape, the upper frequency may be extended appreciably. Shaping of the antenna elements can also be done without reducing the opening angle, and vice versa, as per the requirements.

The antenna formed by elements 301 and 302 can be called a main antenna, whereas the other antenna 350 can be used for auxiliary functions. For example, such an arrangement can be used to build a combined multi-band antenna, which can save costs and space.

In an another embodiment, at least one of the, antenna elements, and/or the feed lines are realized as PCB traces. In yet another embodiment, at least one of the, antenna elements, and/or the feed lines are realized as traces using any thin-film or thick film process. In yet another embodiment, at least one of the, antenna elements, and/or the feed lines are realized in a semi-conductor manufacturing process.

Present teachings also relate to the use of a connection point according to the teachings of this disclosure for enhancing the frequency range or wideband performance of an antenna. More specifically, the teachings relate to the use of a conductive connection 333 in the feeding network for feeding an antenna. The antenna comprises two antenna elements or poles, 301 and 302 respectively. preferably in the form of a short circuit, made between the first conducting line 313 and the second conducting line 323 at a predetermined length 390 from the antenna elements. The feeding network comprises the first conducting line 313 and the second conducting line 323. The details of the antenna and the feeding network are already discussed in this disclosure, e.g., in context of FIG. 3. Accordingly, the present teachings also relate to the use of an antenna balun comprising the connection point for enhancing the frequency range or wideband performance of an antenna.

The examples in this disclosure are shown in their simplest sense for ease of explanation, and without limiting the scope or generality of the present teachings. A person skilled in the art will understand that the present teachings can be applied to different types of antennas. The teachings can be applied to any wireless application where a balun type functionality is required. The skilled person will also appreciate that the embodiments explained in this disclosure can be combined with each other to realize a wireless device according to specific requirements. Discussion of an embodiment separately does not mean that the embodiment cannot be used with the rest of the examples or embodiments presented herein.

To summarize, the present teachings relate to an antenna comprising a first element and a second element. The first element and the second element are arranged to be poles of the antenna. The antenna is adapted to be fed by a feeding network, wherein the feeding network comprises a first feed line having a first antenna end and a first device end. The first feed line has a first length spanning between the first antenna end and the first device end. The first feed line comprises a first electrical conductor and a second electrical conductor. The first electrical conductor is electrically continuous or has electrical conductivity along the first length. This means that two connections made at the first device end and the first antenna end respectively with the first electrical conductor will be electrically connected through the first electrical conductor spanning along the first length. Similarly, the second electrical conductor also has electrical continuity along said first length. The first electrical conductor and the second electrical conductor however are electrically isolated from each other along the first length. The antenna also comprises a second feed line having second antenna end and a second device end. The second feed line has a second length spanning between the second antenna end and the second device end. The second feed line comprises a third electrical conductor. The third electrical conductor has electrical continuity along said second length. In other words the third electrical conductor is electrically continuous along the first length. This means that two connections made at the second device end and the second antenna end respectively with the third electrical conductor will be electrically connected through the third electrical conductor spanning along the second length. The first electrical conductor is adapted to be electrically connected to the first antenna element at or close to the first antenna end. The second electrical conductor is adapted to be electrically connected to the second antenna element at or close to the first antenna end. The third electrical conductor is adapted to be electrically connected to the second antenna element at or close to the second antenna end. The feeding network also comprises an electrical connection between the first electrical conductor and the third electrical conductor, the electrical connection is done at a connection point located at a predetermined distance from a reference point related to the antenna elements. The predetermined distance is shorter than at least one of the first length and the second length. This is especially the case when predetermined distance is measured from the axis of symmetry running along the length of the antenna—when the antenna is dipole type. Preferably, the location of the electrical connection is chosen such that the impedance presented by it is inductive at low frequency range where the impedance of the first element and the second element is capacitive. The location is chosen such that the inductive impedance due to the connection point at least partially compensates for the capacitive impedance of the antenna elements below the half wavelength frequency. The connection point lies preferably at a distance at or below $\lambda/4$ from the antenna defined from the physical dimensions of the antenna.

In another embodiment, the second feed line also comprises a fourth electrical conductor, the fourth electrical conductor having electrical continuity along said certain length of the second feed line. The third electrical conductor and the fourth electrical conductor are electrically isolated from each other along the length of the second feed line.

According to another embodiment, the fourth electrical conductor is connected to an auxiliary antenna or a sensor.

According to yet another embodiment, the second feed line also comprises a third length. Said third length is spanning between a third antenna end and a remote end. The third antenna end is close to the second antenna end. The third antenna end and the second antenna end are preferably the same. Each of the third electrical conductor and the fourth electrical conductor are electrically continuous along their respective lengths between the second device end and the remote end. In other words, the third and fourth conductors have each continuity between the second device end and remote end. The third electrical conductor and the fourth electrical conductor however are electrically isolated from each other between the remote end and the device end.

In another embodiment, said auxiliary antenna is connected to the fourth electrical conductor at or close to the remote end.

In yet another embodiment, said sensor is connected to the fourth electrical conductor at or close to the remote end.

In another embodiment, at least one of the first feed line and the second feed line is a co-axial cable. In yet another embodiment, at least one of the first feed line and the second feed line is a microstrip. In yet another embodiment, at least one of the first feed line and the second feed line is a stripline. In yet another embodiment, at least one of the first feed line and the second feed line is a coplanar waveguide.

In further embodiments, at least one of the first device end and the second device end is operatively connected to a transmitter, receiver, or a transponder.

In another embodiment, at least the first element and the second element are a part of a GPS antenna.

In yet another embodiment, the auxiliary antenna is a mobile communications antenna. By mobile communications it is meant, GSM, CDMA, or such.

In another embodiment, the antenna is a combined multiband antenna.

In another embodiment, the first element and the second element form at least partially a bow-tie or an hourglass type dipole having an antenna length and an element width. Preferably, the antenna length is around 100 mm; the element width is around 60 mm; and the predetermined distance is around 22 mm when measured from axis of symmetry running along the antenna length.

The present teachings also relate to an antenna balun comprising a first feed line and a second feed line. The first feed line has a first length spanning between a first antenna end and a first device end. The first feed line comprises a first electrical conductor and a second electrical conductor. The first electrical conductor and the second electrical conductor are electrically isolated from each other along the first length. The second feed line has a second length spanning between a second antenna end and a second device end. The second feed line comprises a third electrical conductor and a fourth electrical conductor. The first electrical conductor and the second electrical conductor are electrically isolated from each other along the second length. The balun comprises an electrical connection between the first electrical conductor and the third electrical conductor, the electrical connection being at a connection point located at a predetermined distance from the first antenna end or the second antenna end. The first antenna end is configured to be connected to a first antenna element, and the second antenna end is configured to be connected to a second antenna element. Preferably, the location of the electrical connection is chosen such that the impedance presented by it is inductive at low frequency range where the impedance of the first element and the second element is capacitive. The location is chosen such that the inductive impedance due to the connection point at least partially compensates for the capacitive impedance of the antenna elements below the half wavelength frequency.

The present teachings also relate to the use of the antenna balun for enhancing the frequency range of operation of an antenna. More specifically, the frequency range below the half wavelength frequency, defined by the physical dimensions of the antenna, is enhanced.

The invention claimed is:

1. An antenna comprising:

a first element;

a second element;

wherein an axis of symmetry symmetrically divides each of the first element and the second element;

wherein the first element and second element are arranged to be poles of the antenna, the antenna being adapted to be fed by a feeding network;

wherein the feeding network comprises;

a first feed line having a first antenna end and a first device end; and a first length between the first antenna end and the first device end;

the first feed line comprising a first electrical conductor and a second electrical conductor;

each of the first electrical conductor and second electrical conductor having electrical continuity along the first length; and the first electrical conductor and the second electrical conductor being electrically isolated from each other along the first length; and a second feed line having second antenna end and a second device end; and a second length between the second antenna end and the second device end;

the second feed line comprising:

a third electrical conductor, the third electrical conductor having electrical continuity along the second length; wherein the first electrical conductor is adapted to be electrically connected to the first element at or close to the first antenna end;

the second electrical conductor is adapted to be electrically connected to the second element at or close to the first antenna end; and the third electrical conductor is adapted to be electrically connected to the second antenna element at or close to the second antenna end;

wherein the feeding network also comprises:

an electrical connection between the first electrical conductor and the third electrical conductor;

the electrical connection being at a connection point located at a predetermined distance from a reference point at the axis of symmetry; and the predetermined distance being shorter than at least one of the first length and the second length; and the location of the electrical connection is such that the inductive impedance due to the connection point at least partially compensates for the capacitive impedance of the antenna elements at least substantially below the half wavelength frequency defined by the dimensions and arrangement of the antenna elements, the predetermined distance of the connection point being below $\lambda/6$.

2. The antenna according to claim 1, wherein:
the second feed line also comprises a fourth electrical conductor,
the fourth electrical conductor having electrical continuity along the certain length of the second feed line, and
the third electrical conductor and the fourth electrical conductor being electrically isolated from each other along the length of the second feed line.

3. The antenna according to claim 2, wherein the fourth electrical conductor is connected to an auxiliary antenna.

4. The antenna according to claim 2, wherein the fourth electrical conductor is connected to a sensor.

5. The antenna according to claim 2, wherein:
the second feed line also comprises a third length,
the third length spanning between a third antenna end and a remote end,
with each of the third electrical conductor and the fourth electrical conductor having electrical continuity along their respective lengths between the second device end and the remote end, and
the third electrical conductor and the fourth electrical conductor being electrically isolated from each other between the remote end and the device end.

6. The antenna according to claim 5, wherein the third electrical conductor is further electrically connected to the second antenna element at or close to the remote end.

7. The antenna according to claim 5, wherein the auxiliary antenna is connected to the fourth electrical conductor at or close to the remote end.

8. The antenna according to claim 4, wherein the sensor is connected to the fourth electrical conductor at or close to the remote end.

9. The antenna according to claim 1, wherein at least one of the first feed line and the second feed line is a co-axial cable.

10. The antenna according to claim 1, wherein at least one of the first feed line and the second feed line is a type from a group composed of, microstrip, stripline, or coplaner waveguide.

11. The antenna according to claim 1, wherein at least one of the first device end and the second device end is operatively connected to a transmitter.

12. The antenna according to claim 1, wherein at least one of the first device end and the second device end is operatively connected to a receiver.

13. The antenna according to claim 1, wherein at least the first element and the second element are a part of a GPS antenna.

14. The antenna according to claim 3, wherein the auxiliary antenna is a mobile communications antenna.

15. The antenna according to claim 3, wherein the antenna is a combined multi-band antenna.

16. The antenna according to claim 1, wherein the first element and the second element form at least partially a bow-tie or an hourglass type dipole having an antenna length and an element width.

17. The antenna according to claim 16, wherein:
the antenna length is around 100 mm;
the element width is around 60 mm; and
the predetermined distance is around 22 mm when measured from the axis of symmetry.

18. An antenna balun comprising:
a first feed line and a second feed line,
the first feed line having a first length between a first antenna end and a first device end,
the first feed line comprising:
a first electrical conductor and a second electrical conductor,
the first electrical conductor and the second electrical conductor being electrically isolated from each other along the first length; and
the second feed line having a second length between a second antenna end and a second device end,
the second feed line comprising:
a third electrical conductor and a fourth electrical conductor, and
the first electrical conductor and the second electrical conductor being electrically isolated from each other along the second length,
wherein the balun comprises:
an electrical connection between the first electrical conductor and the third electrical conductor, and
the electrical connection being at a connection point located at a predetermined distance from the first antenna end or the second antenna end;
the first antenna end being configured to be connected to a first antenna element, and
the second antenna end being configured to be connected to a second antenna element; and
the location of the electrical connection is such that the inductive impedance due to the connection point at least partially compensates for the capacitive impedance of the antenna elements at least substantially below the half wavelength frequency defined by the dimensions and arrangement of the antenna elements, wherein the distance of the connection point is below $\lambda/6$.

* * * * *